US005178102A

United States Patent [19]

Kehrer et al.

[11] Patent Number: 5,178,102

[45] Date of Patent: Jan. 12, 1993

[54] HEAT EXCHANGER FOR COOLING SUPERHEATED STEAM

[75] Inventors: Wolfgang Kehrer; Helmut Lachmann; Konrad Nassauer, all of Berlin, Fed. Rep. of Germany

[73] Assignee: Deutsche Babcock-Borsig Aktiengesellschaft, Berlin, Fed. Rep. of Germany

[21] Appl. No.: 711,179

[22] Filed: Jun. 3, 1991

[30] Foreign Application Priority Data

Jun. 9, 1990 [DE] Fed. Rep. of Germany ..... 4018569

[51] Int. Cl.[5] ..... F28F 9/00

[52] U.S. Cl. ..... 122/367.1; 165/103; 165/163

[58] Field of Search ..... 122/367; 165/103, 163

[56] References Cited

U.S. PATENT DOCUMENTS

| | | | |
|---|---|---|---|
| 170,743 | 12/1875 | Kirby | 165/103 |
| 1,807,538 | 5/1931 | Leek | 165/103 |
| 4,450,904 | 5/1984 | Volz | 165/163 |

FOREIGN PATENT DOCUMENTS

| | | | |
|---|---|---|---|
| 1303092 | 8/1970 | United Kingdom | 165/103 |

*Primary Examiner*—A. Michael Chambers
*Attorney, Agent, or Firm*—Max Fogiel

[57] ABSTRACT

A heat exchanger for cooling superheated steam with water, yielding saturated steam. The heat exchanger consists of U-shaped pipes (4) that the superheated steam flows through. The pipes are accommodated in a jacket (1) provided with intakes (10 & 11) and outlets (12 & 13) for the evaporating water. The pipes have their ends secured in a slab of tubes. The slab demarcates a chamber that is separated by a partition into an intake compartment (17) with an intake (14) and an outlet compartment (18) with an outlet (15). To improve the generic heat exchanger, part of the partition (16) has been removed and replaced with a rotating plate (19), the plate is attached to a rotating disk (21) that is perpendicular to the plate and has an opening (22) through it and a solid section on each side of the plate, the rotating disk faces a stationary disk (23) secured to the inner surface of the chamber (7) away from and parallel with the slab (5) and provided with openings (24) and solid sections that are similar to those in the rotating disk, and the side of the slab that faces away from the chamber rests on a thicker support (8).

10 Claims, 2 Drawing Sheets

HEAT EXCHANGER FOR COOLING SUPERHEATED STEAM

BACKGROUND OF THE INVENTION

The superheated steam occurring in chemical-processing and power plants must be cooled when it is employed to drive turbines or when it is usually necessary but no longer desired in special operating conditions when saturated steam is used at the same or a lower pressure.

The coolers employed are either spray-type coolers, which operate with degassed water or pure condensed steam, or surface coolers, wherein the superheated steam is cooled indirectly by evaporating water at an equal or lower pressure (Dubbel Taschenbuch für den Maschinenbau, 14th ed., 1981, p. 606). The use of spray-type coolers is limited in some situations when not enough satisfactory water is available. Surface coolers have advantages over spray-type coolers in that the quality of the steam being cooled remains constant and that steam is simultaneously generated by the cooling process. Separating the superheated steam being cooled into component currents facilitates regulating the temperature and volume of the resulting saturated steam. Surface coolers are mainly nested-tube heat exchangers (op. cit., p. 545).

SUMMARY OF THE INVENTION

The object of the present invention is to improve the generic heat exchanger for cooling superheated steam to the extent that it can be employed in a process-gas and steam generating system in a petrochemical plant, that volumes can easily be regulated, and that it will be able to resist extreme stress.

The slab or tube sheet of tubing in the heat exchanger in accordance with the invention is thin enough to cool well and can accordingly be subjected to superheated steam at a high temperature. The thinness of the slab also prevents extensive differences in temperature between the surface that is subjected to the superheated steam and the surface that is cooled. The cooler is accordingly insensitive to the thermal shock that occurs during emergency operation in the event of the momentary introduction of a lot of highly superheated steam. The plate that rotates in the partition constitutes in conjunction with system of disks a bypass. The bypass is integrated into the chamber and allows the compulsory regulation of any desired volume. No complicated external bypass lines and controls are necessary. Its compactness allows the heat exchanger in accordance with the invention to be employed to advantage in petrochemical plants, especially to steam-reform process gas from hydrocarbons.

BRIEF DESCRIPTION OF THE DRAWINGS

One embodiment of the invention will now be specified with reference to the drawing, wherein.

DESCRIPTION OF THE PREFERRED EMBODIMENTS

Figure 2:
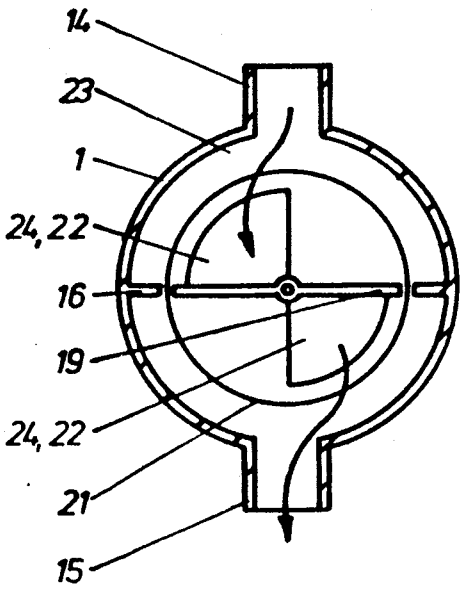
FIG. 2 is a section along line II—II in FIG. 1.

A heat exchanger is employed to cool superheated steam and consists of a cylindrical jacket 1 that is closed off at each end by a floor 2 and 3. Jacket 1 accommodates U-shaped pipes 4, only one of which is illustrated for the sake of simplicity. U-shaped pipes 4 are accommodated in a slab or tube sheet 5 of pipes that is tightly secured to jacket 1.

Slab 5 separates the inside of jacket 1 into a space 6 that accommodates U-shaped pipes 4 and a chamber 7. Slab 5 is thin, and the side that faces away from chamber 7 rests on a thicker support 8 secured in jacket 1. The supporting components are bolt-shaped fingers 9 cast onto support 8 and connected to slab 5. The forces generated by pressure and heat and acting on thin slab 5 are diverted by fingers 9 into support 8. The support is provided with annular gaps, through which U-shaped pipes 4 extend, leaving space around it.

The section of jacket 1 that surrounds space 6 has two intakes 10 and 11 and two outlets 12 and 13 for a coolant. One intake 11 and one outlet 13 open into the space between thin slab 5 and support 8, ensuring that the slab is extensively cooled. The coolant is water evaporated by heat extracted from the superheated steam flowing through U-shaped pipes 4. The resulting saturated steam leaves through outlets 12 and 13. Outlets 12 and 13 communicate through unillustrated ascenders and intakes 10 and 11 through unillustrated descenders, creating a natural circulation, with a drum, wherein the water is separated from the steam.

Chamber 7 has an intake 14 and an outlet 15. Between them is a partition 16 that extends along the same plane as the longitudinal central axis of jacket 1 and over the total cross-section of chamber 7 between floor 3 and slab 5. Partition 16 separates chamber 7 into an intake compartment 17, which accommodates intake 14, and an outlet compartment 18, which accommodates outlet 15. The ends of U-shaped pipes 4 are on each side of partition 16, with their intake end opening out of intake compartment 17 and their outlet ends into outlet compartment 18.

Part of partition 16 has been removed and replaced with a rotating plate 19, which is connected to an axis 20 that coincides with the longitudinal central axis of jacket 1 and projects out of chamber 7 through floor 3. Rotating plate 19 can be rotated to any angle out of the plane of partition 16 by means of a drive mechanism that engages axis 20.

Secured to rotating plate 19 is a rotating disk 21 that extends within the radial plane of jacket 1 and perpendicular to rotating plate 19. The diameter of rotating disk 21 equals the length of rotating plate 19. Rotating disk 21 has an opening 22 extending through it on each side of its point of attachment to rotating plate 19. Opening 22 are in the shape of a vertical sector in each quadrant of a circle, the other quadrant being solid. The two openings are diametrically opposite each other.

Rotating disk 21 rests on a stationary disk 23 secured below chamber 7 to the inner surface of jacket 1 and away from and parallel with slab 5. Stationary disk 23 has, like rotating disk 21, openings 24 through it on each side of partition 16. The openings 24 in stationary disk 23 are identical with those in rotating disk 21 in size, shape, and distribution.

Figure 1:
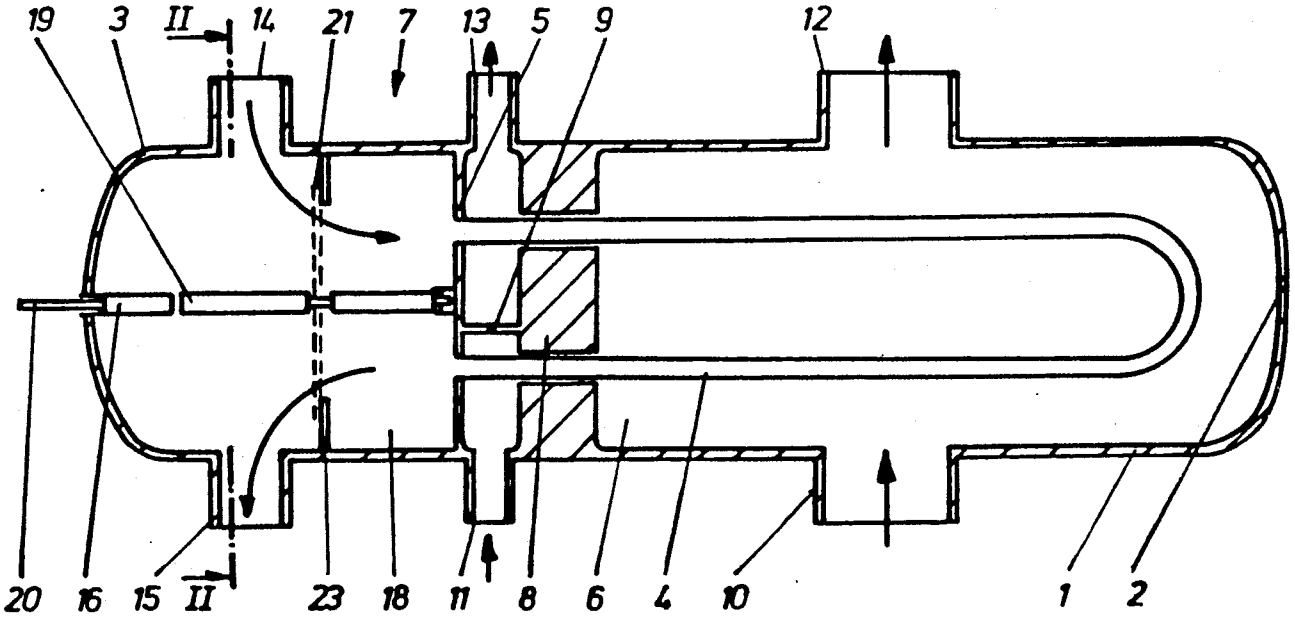
FIG. 1 is a longitudinal section through a heat exchanger for cooling superheated steam.

Rotating plate 19 and the rotating disk 21 secured to it constitute in conjunction with stationary disk 23 a bypass that operates as will now be described. When rotating plate 19 is in the same plane as partition 16 as illustrated in FIGS. 1 and 2, the openings 22 in rotating disk 21 will coincide with the openings 24 in stationary disk 23. The superheated steam entering intake compartment 17 will, with the exception of any lost through leakage, all flow into U-shaped pipes 4 through openings 22 and 24. As it flows through U-shaped pipes 4, the steam will cool off by loosing heat to the evaporating water in space 6. The cool steam will flow out of U-shaped pipes 4, through the openings 22 and 24 below partition 16 and rotating plate 19, and into outlet compartment 18 and will exit through outlets 15.

Figure 4:
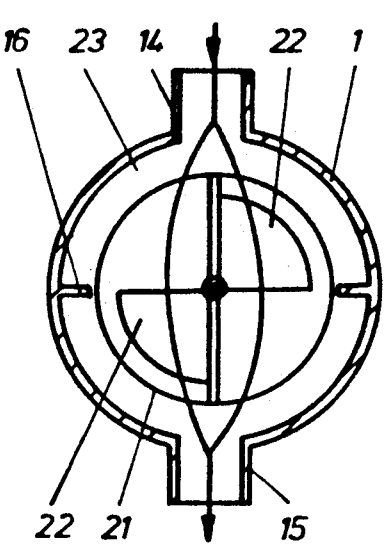
FIG. 4 is a section along the line IV—IV in FIG. 3.
Figure 3:
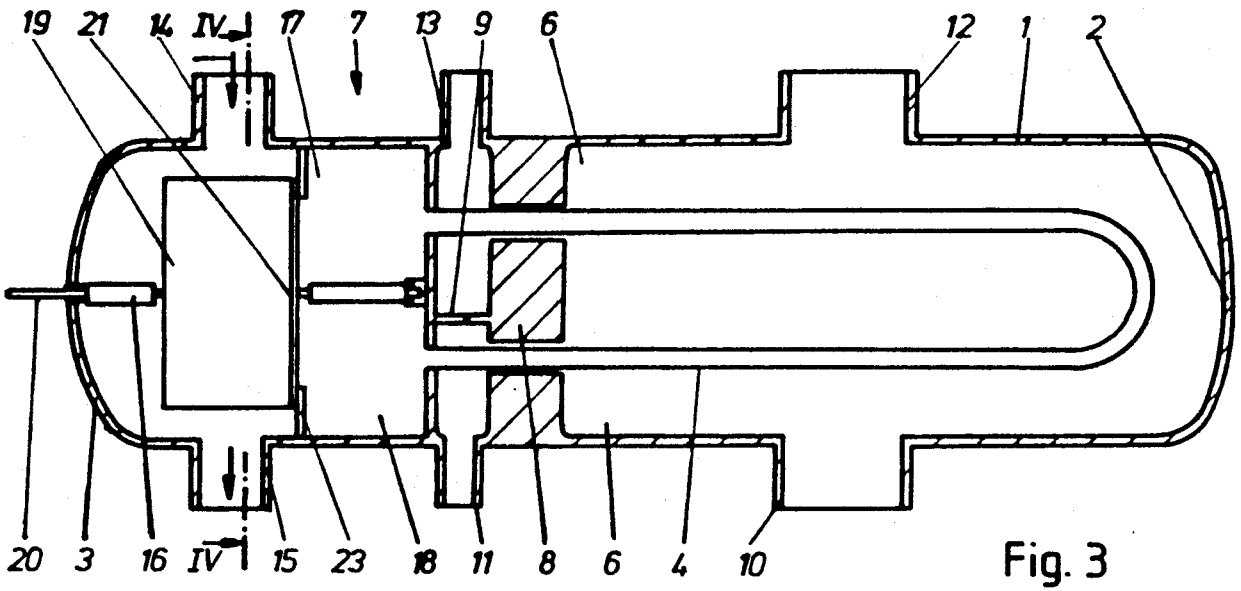
FIG. 3 is a longitudinal section through the heat exchanger illustrated in FIG. 1 with the bypass in a different position.
Figure 6:
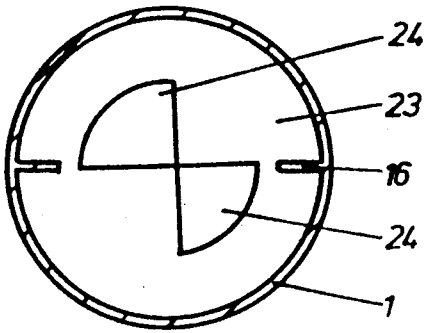
FIG. 6 is a top view of the stationary disk.
Figure 5:
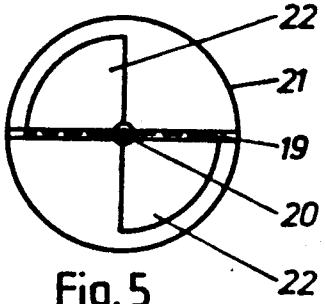
FIG. 5 is a top view of the rotating disk in the position illustrated in FIG. 1.

Rotating plate 19 is represented perpendicular to partition 16 in FIGS. 3 and 4. In this position one opening 22 or 24 in one rotating disk 21 or 23 is, due to the opposite-quadrant distribution, always opposite the solid section of the other disk 21 or 23, and the openings are closed off on the whole. The access to U-shaped pipes 4 from chamber 7 is blocked. The superheated steam entering intake compartment 17 accordingly immediately arrives in outlet compartment 18, which it leaves without having been cooled. Every intermediate position between these two positions is possible.

We claim:

1. A heat exchanger for cooling superheated steam with water to produce saturated steam, comprising: a plurality of U-shaped pipes with ends for conducting superheated steam; a jacket for housing said U-shaped pipes; first intake means and first outlet means on said jacket for conducting evaporating water through said jacket; a tube sheet connected to said ends of said U-shaped pipes and bordering a chamber; partition means for separating said chamber into an intake compartment with second intake means and an outlet chamber with second outlet means; a rotating plate in a removed part of said partition means; a rotating disk attached perpendicular to said rotating plate and having an opening, said rotating disk having a closed solid section on each side of said rotating plate; a stationary disk facing said rotating disk and secured to an inner surface of said chamber spaced from said tube sheet and parallel to said tube sheet; said stationary disk having openings and solid sections similar to the openings and solid sections in said rotating disk; and a support thicker than said tube sheet, a side of said tube sheet facing away from said chamber and resting on said support, said tube sheet being relatively thin for cooling at a rate to raise the superheated steam to a high temperature, thinness of said tube sheet also preventing substantial differences in temperature between a surface of said tube sheet in contact with the superheated steam and a surface of said tube sheet being cooled; said rotating plate cooperating with said rotating disk and said stationary disk to form a bypass for volume regulation.

2. A heat exchanger as defined in claim 1, wherein said opening in said rotating disk and said opening in said stationary disk have each a shape of a sector of a quadrant of a circle, said solid sections of said rotating disk and said stationary disk having also the shape of a sector of a quadrant of a circle.

3. A heat exchanger as defined in claim 1, wherein said heat exchanger is operable in a process-gas and steam generating system in a petrochemical plant.

4. A heat exchanger as defined in claim 1, wherein said support has bolt-shaped fingers cast onto said support and connected to said tube sheet, forces generated by pressure and heat and acting on said tube sheet being diverted by said fingers into said support, said support having annular gaps for receiving said U-shaped pipes.

5. A heat exchanger as defined in claim 1, wherein said water is a coolant that is water evaporated by heat extracted from the superheated steam flowing through said U-shaped pipes.

6. A heat exchanger as defined in claim 1, wherein said jacket has a longitudinal central axis, said partition means extending along said longitudinal central axis and over a total cross section of said chamber between a bottom surface of said chamber and said tube sheet.

7. A heat exchanger as defined in claim 1, wherein said rotating plate is rotatable to any angle from said partition means.

8. A heat exchanger as defined in claim 1, wherein said rotating disk has a diameter and said rotating plate has a length, the diameter of said rotating disk being equal to the length of said rotating plate.

9. A heat exchanger as defined in claim 1, wherein the openings in said stationary disk are identical to the openings in said rotating disk in size, shape, and distribution.

10. A heat exchanger for cooling superheated steam with water to produce saturated steam, comprising: a plurality of U-shaped pipes with ends for conducting superheated steam; a jacket for housing said U-shaped pipes; first intake means and first outlet means on said jacket for conducting evaporating water through said jacket; a tube sheet connected to said ends of said U-shaped pipes and bordering a chamber; partition means for separating said chamber into an intake compartment with second intake means and an outlet chamber with second outlet means; a rotating plate in a removed part of said partition means; a rotating disk attached perpendicular to said rotating plate and having an opening, said rotating disk having a closed solid section on each side of said rotating plate; a stationary disk facing said rotating disk and secured to an inner surface of said chamber spaced from said tube sheet and parallel to said tube sheet; said stationary disk having openings and solid sections similar to the openings and solid sections in said rotating disk; and a support thicker than said tube sheet, a side of said tube sheet facing away from said chamber and resting on said support, said tube sheet being relatively thin for cooling at a rate to raise the superheated steam to a high temperature, thinness of said tube sheet also preventing substantial differences in temperature between a surface of said tube sheet in contact with the superheated steam and a surface of said tube sheet being cooled; said rotating plate cooperating with said rotating disk and said stationary disk to form a bypass for volume regulation; said opening in said rotating disk and said opening in said stationary disk having a shape of a sector of a quadrant of a circle, said solid section of said rotating disk and said solid section of said stationary disk each having the shape of a sector of a quadrant of a circle; said heat exchanger operating in a process-gas and steam generating system in a petrochemical plant; said support having bolt-shaped fingers cast onto said support and connected to said tube sheet, forces generated by pressure and heat and acting on said tube sheet being diverted by said fingers into said support, said support having annular gaps for receiving said U-shaped pipes; said water being a coolant evaporated by heat extracted from the superheated steam flowing through said U-shaped pipes; said jacket having a longitudinal central axis, said partition means extending along said longitudinal central axis and over a total cross section of said chamber between a bottom surface of said chamber and said tube sheet; said rotating plate being rotatable to any angle from said partition means; said rotating disk having a diameter equal to a length of said rotating plate; said openings in said stationary disk being identical to said openings in said rotating disk in size, shape, and distribution.

* * * * *